US007495617B2

(12) United States Patent
Su et al.

(10) Patent No.: US 7,495,617 B2
(45) Date of Patent: Feb. 24, 2009

(54) MULTI-BAND ANTENNA

(75) Inventors: Jia-hung Su, Tu-Cheng (TW); Ching-chi Lin, Tu-Cheng (TW); Jen-hung Chen, Tu-Cheng (TW); Kai Shih, Tu-Cheng (TW); Yu-yuan Wu, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 108 days.

(21) Appl. No.: 11/798,195

(22) Filed: May 11, 2007

(65) Prior Publication Data

US 2008/0278389 A1 Nov. 13, 2008

(51) Int. Cl.
*H01Q 1/38* (2006.01)

(52) U.S. Cl. ..... 343/700 MS; 343/702

(58) Field of Classification Search ..... 343/700 MS, 343/702, 846

See application file for complete search history.

(56) References Cited

U.S. PATENT DOCUMENTS 6,784,843 B2 * 8/2004 Onaka et al. ..... 343/700 MS
7,119,748 B2 * 10/2006 Autti ..... 343/702
2001/0050643 A1 * 12/2001 Egorov et al. ..... 343/702

* cited by examiner

*Primary Examiner*—Hoang V Nguyen
(74) *Attorney, Agent, or Firm*—Rosenberg, Klein & Lee

(57) ABSTRACT

A multi-band antenna is arranged on a housing with a first surface, a second surface opposite to the first surface, and a third surface connecting the first and second surfaces, which has a first radiating conductor and a parasitic element formed as an elongated shape and arranged on the first surface. A trap circuit connects the first radiating conductor and the parasitic element. A ground portion is arranged on the second surface. A second radiating conductor is arranged on the third surface and spaced from the first radiating conductor and the ground portion, which is formed as an elongated shape. A feeding conductor with a feeding point connects the first and second radiating conductors. The multi-band antenna obtains a low frequency band through the cooperation of the first radiating, the parasitic element and the trap circuit, and a high frequency band through the second radiating conductor and the parasitic element.

26 Claims, 5 Drawing Sheets

| | |
|---|---|
| M1 | 824 MHz |
| M2 | 960 MHz |
| M3 | 1710 MHz |
| M4 | 1880 MHz |
| M5 | 1990 MHz |
| M6 | 2170 MHz |

MULTI-BAND ANTENNA

BACKGROUND OF THE INVENTION

1. Field of the Invention

The invention relates to a multi-band antenna, and particularly to a multi-band antenna with simple structure adapted to be configured in a portable electrical device.

2. The Related Art

A portable communication device has an antenna structure that supports wireless communication in multiple operating frequency bands, such as global system mobile (GSM) and wideband code division multiple access (W-CDMA) nowadays. Many different types of antennas for the portable communication device are used, including helix, inverted-F, folded dipole, and retractable antenna structures. Helix antenna and retractable antenna are typically installed outside the portable communication device. Inverted-F antenna and folded dipole antenna are typically embedded inside the portable communication device case or housing.

Generally, embedded antennas are preferred over external antennas for the portable communication device owing to mechanical and ergonomic reasons. Embedded antennas are protected by the portable communication device case or housing and therefore tend to be more durable than external antennas. Nowadays, the portable communication is combined with wireless communication technology and data processing technology for multiple function purpose, such as a notebook. Therefore, the embedded antenna capable of operating at various wireless communication bands and being configured in the notebook is a development point.

SUMMARY OF THE INVENTION

An object of the present invention is to provide a multi-band antenna having a housing, a first radiating conductor, a second radiating conductor, a parasitic element, a trap circuit, a feeding conductor with a feeding point and a ground portion. The housing defines a first surface, a second surface opposite to the first surface, and a third surface connecting the first and second surfaces. The first radiating conductor and the parasitic element are arranged on the first surface of the housing and formed as an elongated shape.

The trap circuit arranged on the first surface of the housing electronically connects the first radiating conductor and the parasitic element. The ground portion is arranged on the second surface of the housing. The second radiating conductor is formed as an elongated shape, which is arranged on the third surface of the housing and spaced from the first radiating conductor and the ground portion. The feeding conductor electronically connects the first and second radiating conductors.

According to the arrangement of the first and second radiating conductors, the parasitic element and the trap circuit, the multi-band antenna has a simple structure and a small volume adapted to be configured in a portable electrical device. When the multi-band antenna operates at wireless communication, the cooperation of the first radiating conductor, the trap circuit and the parasitic element obtains the 824-960 MHz frequency band and the parasitic element and the second radiating conductor obtain the 1710-2170 MHz frequency band.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
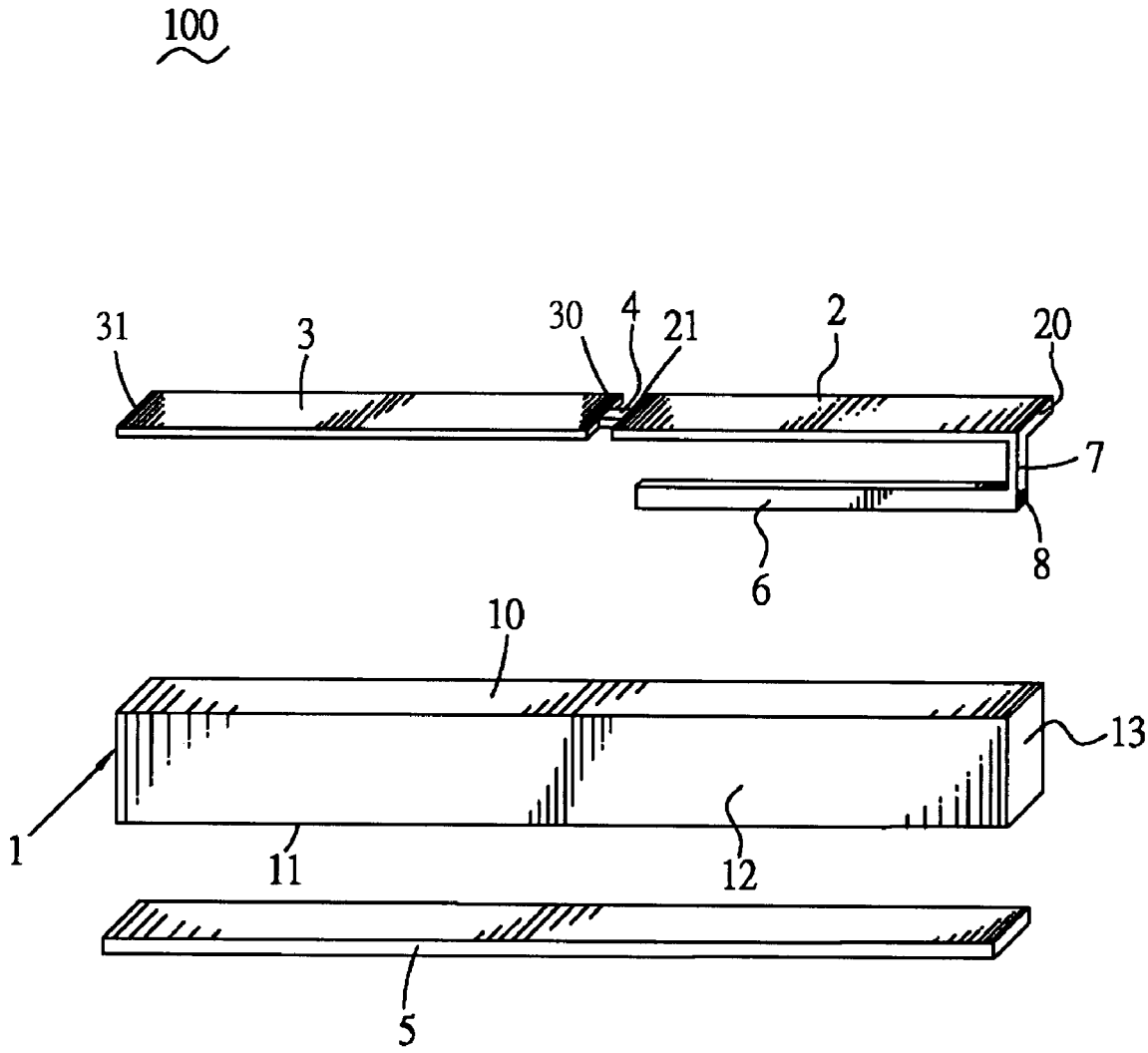
FIG. 1 is an exploded view of a first preferred embodiment of a multi-band antenna according to the present invention.
Figure 2:
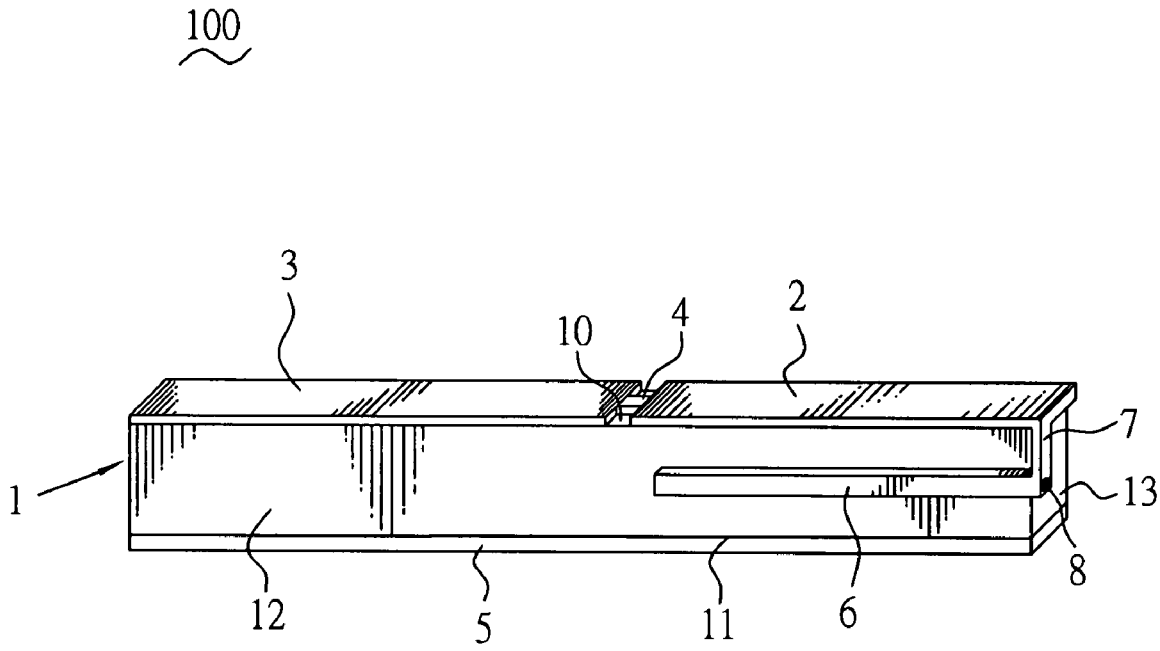
FIG. 2 is perspective view of the first preferred embodiment of the multi-band antenna according to the present invention.

Please refer to FIG. 1 and FIG. 2. A first preferred embodiment of a multi-band antenna 100 according to the present invention is shown. The multi-band antenna 100 is arranged on a housing 1. The housing 1 has a first surface 10, a second surface 11 opposite to the first surface 10, a third surface 12 connecting the first surface 10 and the second surface 11, and a fourth surface 13 connecting the first surface 10, the second surface 11 and the third surface 12. In this case, the housing 1 is made of insulation material and formed as a rectangle.

The area of the first surface 10 of the housing 1 is similar to the area of the second surface 11 of the housing 1. The area of the third surface 12 of the housing 1 is larger than the area of the first surface 10 and the area of the second surface 11 of the housing 1. The area of the fourth surface 13 of the housing 1 is smaller than the area of the first surface 10, the area of the second surface 11 and the area of the third surface 12 of the housing 1.

The multi-band antenna 100 has a first radiating conductor 2, a parasitic element 3 and a trap circuit 4. The first radiating conductor 2 is arranged on the first surface 10 of the housing 1, which defines a first end 20 and a second end 21 opposite to the first end 20. The parasitic element 3 is arranged on the first surface 10 of the housing 1 defining a third end 30 and a fourth end 31. The third end 30 of the parasitic element 3 is arranged to face the second end 21 of the first radiating conductor 2. A trap circuit 4 arranged on the first surface 10 of the housing 1 electronically connects the first radiating conductor 2 and the parasitic element 3.

In this case, the first radiating conductor 2 and the parasitic element 3 are made of thin foil. The first radiating conductor 2 and the parasitic element 3 are formed as an elongated shape. The trap circuit 4 is arranged between the second end 21 of the first radiating conductor 2 and the third end 30 of the parasitic element 3. The trap circuit 4 may be capacitance, inductance or combination of capacitance and inductance.

The multi-band antenna 100 further has a ground portion 5, a second radiating conductor 6, and a feeding conductor 7 with a feeding point 8. The ground portion 5 is arranged on the second surface 11 of the housing 1. The second radiating conductor 6 is arranged on the third surface 12 of the housing 1 and spaced from the first radiating conductor 2 and the ground portion 5, which defines opposite ends. The feeding conductor 7 electronically connects the first radiating conductor 2 and the second radiating conductor 6.

In this case, the second radiating conductor 6 and the feeding conductor 7 are made of thin foil. The second radiating conductor 6 and the feeding conductor 7 are formed as an elongated shape. The feeding conductor 7 is arranged on the fourth surface 13 of the housing 1, which electronically connects the first end 20 of the first radiating conductor 2 and one end of the second radiating conductor 6. The feeding point 8 is arranged where the feeding conductor 7 connects with the second radiating conductor 6.

Figure 3:
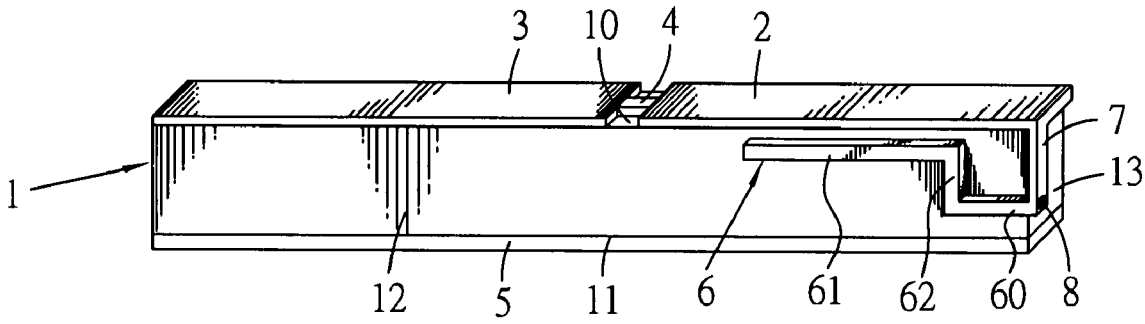
FIG. 3 illustrates a second preferred embodiment of the multi-band antenna according to the present invention.

Please refer to FIG. 3, which shows a second preferred embodiment of the multi-band antenna 100. According to the purpose of balancing gain of the multi-band antenna 100, the second radiating conductor 6 has a first radiating segment 60, a second radiating segment 61 and a third radiating segment 62. The first radiating segment 60 of the second radiating conductor 6 spaced from the ground portion 5 connects with the feeding conductor 7. The second radiating segment 61 of the second radiating conductor 6 is arranged close to the first radiating conductor 2. The third radiating segment 62 connects the first radiating segment 60 and the second radiating segment 61.

In this case, the length of the first radiating segment 60 of the second radiating conductor 6 is shorter than the length of the second radiating segment 61 of the second radiating conductor 6. The gap between the first radiating segment 60 of the second radiating conductor 6 and the ground portion 5 is larger than the gap between the second radiating segment 61 of the second radiating conductor 6 and the first radiating conductor 2.

Figure 4:
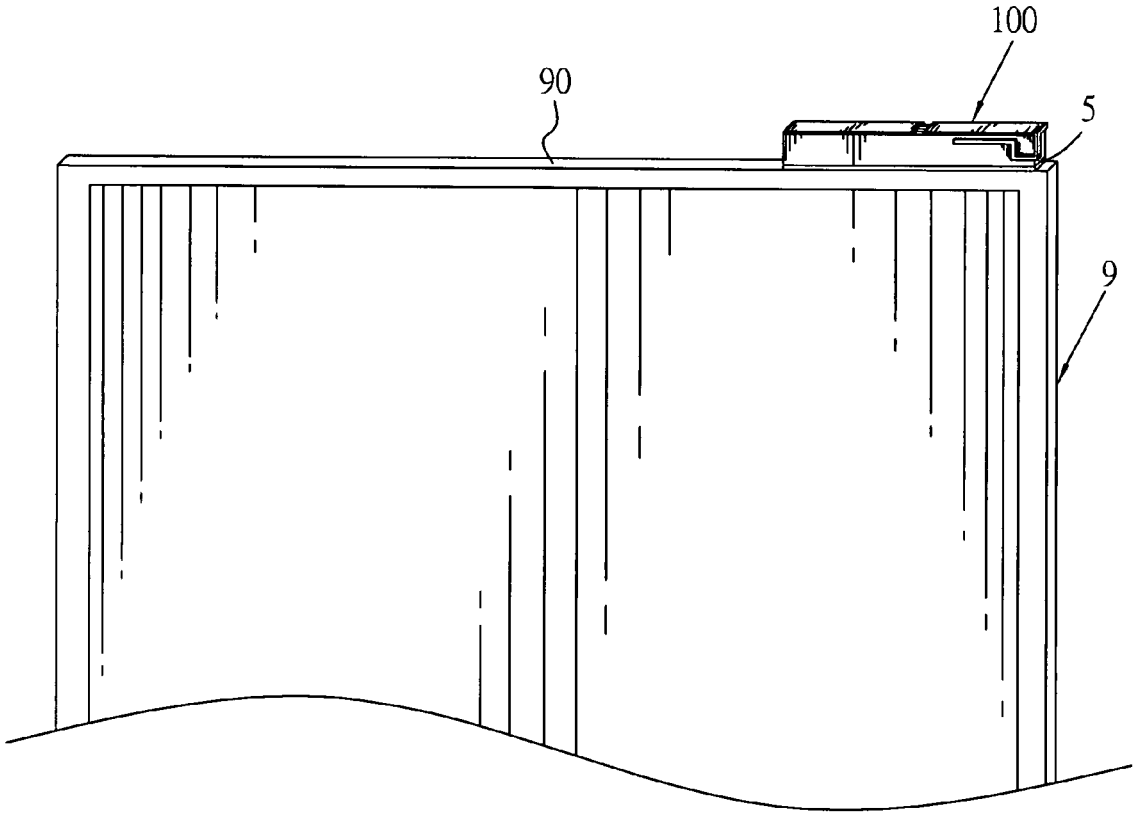
FIG. 4 shows the multi-band antenna being configured on the top surface of the display of a notebook.

Please refer to FIG. 4. The multi-band antenna 100 is configured in a portable electrical device 9, and particular a notebook 9. In this case, the multi-band antenna 100 is arranged on the top surface 90 of the display of the notebook 9. The ground portion 5 of the multi-band antenna 100 electronically connects to ground of the notebook 9 (not shown in figures).

When the multi-band antenna 100 operates at wireless communication, the first radiating conductor 2 obtains an electrical resonance larger than a quarter wavelength corresponding to DCS1800 mega hertz (MHz). The parasitic element 3 obtains an electrical resonance of a half wavelength corresponding to DCS1800 MHz. The second radiating conductor 6 obtains an electrical resonance of a quarter wavelength corresponding to DCS1800 MHz.

Figure 5:
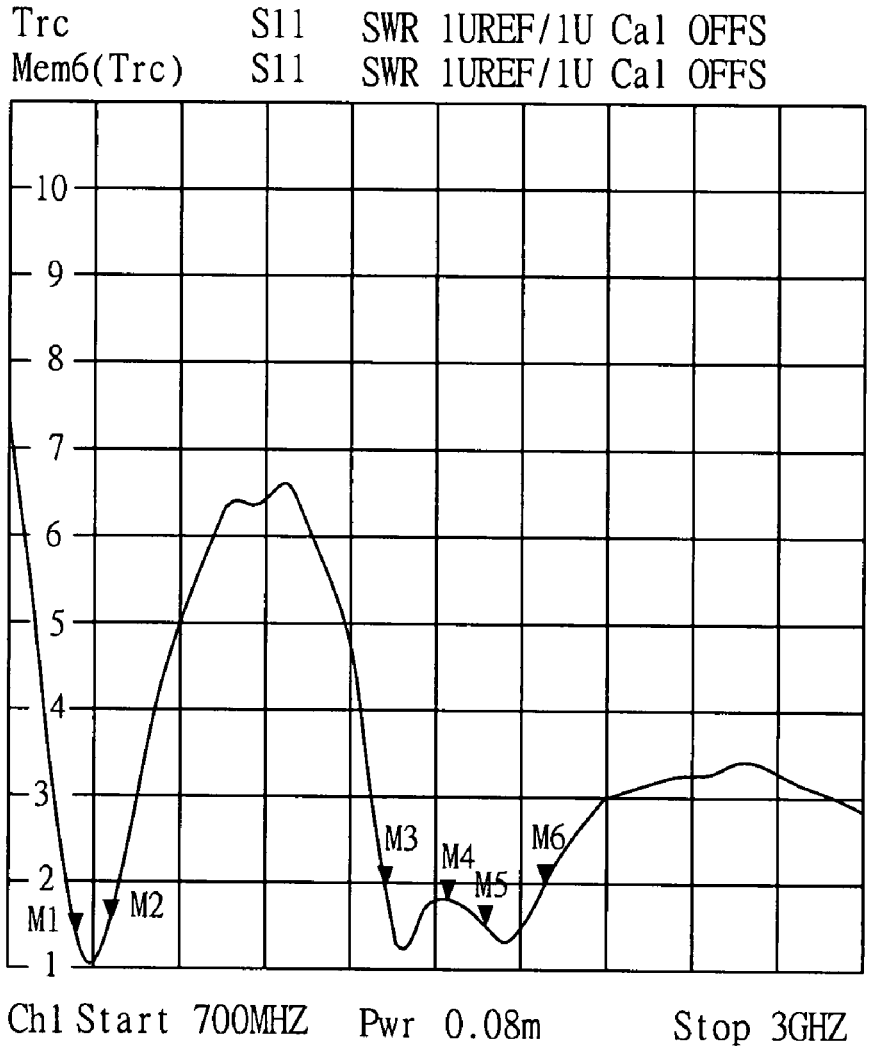
FIG. 5 is a test chart recording for the multi-band antenna of FIG. 2, showing Voltage Standing Wave Ratio (VSWR) as a function of frequency.

Please refer to FIG. 5, which shows a test chart recording of Voltage Standing Wave Ratio (VSWR) of the multi-band antenna 100 as a function of frequency. Note of the VSWR dropping below the desirable maximum value "2" are in the 824-960 MHz and the 1710-2170 MHz frequency bands which cover the bandwidth of wireless communications under GSM850, EGSM900, DCS1800, PCD1900 and W-CDMA2100 standard.

In this case, the cooperation of the first radiating conductor 2, the parasitic element 3 and the trap circuit 4 of the multi-band antenna 100 obtains the 824-960 MHz frequency band. The parasitic element 3 and the second radiating conductor 6 obtain the 1710-2170 MHz frequency band. Further, adjusting of the trap circuit 4 can shift the 824-960 MHz frequency band and bandwidth of the 824-960 MHz frequency band.

According to the arrangement of the first and second radiating conductors, the parasitic element and the trap circuit, the multi-band antenna has a simple structure and a small volume capable of operating at wireless communications and covering the 824-960 MHz and the 1710-2170 MHz frequency bands for adapting to be configured in the portable electrical device.

Furthermore, the present invention is not limited to the embodiments described above; various additions, alterations and the like may be made within the scope of the present invention by a person skilled in the art. For example respective embodiments may be appropriately combined.

What is claimed is:

1. A multi-band antenna, comprising:

a housing defining a first surface, a second surface opposite to said first surface, a third surface connecting said first surface and said second surface, and a fourth surface connecting said first surface, said second surface and said third surface, wherein said first, second and third surfaces are formed as an elongated shape, the area of said first surface being similar to the area of said second surface, the area of said third surface being larger than the area of said first surface, the area of said fourth surface being smaller than the area of said first surface;

a ground portion arranged on said second surface of said housing;

a first radiating conductor with a first end and a second end opposite to said first end, which is arranged on said first surface of said housing;

a parasitic element with a third end facing to said second end of said first radiating conductor, and a fourth end opposite to said third end, being arranged on said first surface of said housing;

a trap circuit arranged on said first surface of said housing and electronically connecting said first radiating conductor and said parasitic element;

a feeding conductor with a feeding point arranged on said fourth surface of said housing, which electronically connects said first end of said first radiating conductor and one end of said second radiating conductor; and a second radiating conductor arranged on said third surface of said housing and spaced from said ground portion and said first radiating conductor, which electronically connects with said feeding conductor.

2. The multi-band antenna as claimed in claim 1, wherein said second radiating conductor has a first radiating segment spaced from said ground portion and connected with said feeding conductor, a second radiating segment arranged close to said first radiating conductor, and a third radiating segment connecting said first radiating segment and said second radiating segment.

3. The multi-band antenna as claimed in claim 2, wherein the length of said first radiating segment of said second radiating conductor is shorter than the length of said second radiating segment of said second radiating conductor.

4. The multi-band antenna as claimed in claim 2, wherein the gap between the first radiating segment of the second radiating conductor and the ground portion is larger than the gap between the second segment of the second radiating conductor and the first radiating conductor.

5. The multi-band antenna as claimed in claim 1, wherein said feeding point is arranged where said feeding conductor connects with said second radiating conductor.

6. The multi-band antenna as claimed in claim 1, wherein said first radiating conductor, said second radiating, said parasitic element are formed as an elongated shape.

7. The multi-band antenna as claimed in claim 1, wherein said feeding conductor is formed as an elongated shape.

8. The multi-band antenna as claimed in claim 1, wherein said trap circuit is arranged between said second end of said first radiating conductor and said third end of said parasitic element.

9. The multi-band antenna as claimed in claim 1, wherein said housing is configured in a portable electrical device, said ground portion of said multi-band antenna electronically connects to ground of said portable electrical device.

10. The multi-band antenna as claimed in claim 1, wherein said portable electrical device is a notebook.

11. The multi-band antenna as claimed in claim 1, wherein said housing is made of insulation material.

12. The multi-band antenna as claimed in claim 1, wherein said first radiating conductor, said second radiating conductor, said feeding conductor and said parasitic element are made of thin foil.

13. A multi-band antenna arranged on a housing defining a first surface, a second surface opposite to said first surface and a third surface connecting said first surface and said second surface, comprising:

a ground portion arranged on said second surface of said housing;

a first radiating conductor with a first end and a second end opposite to said first end, which is arranged on said first surface of said housing;

a parasitic element with a third end facing to said second end of said first radiating conductor, and a fourth end opposite to said third end, which is arranged on said first surface of said housing;

a trap circuit arranged on said first surface of said housing and electronically connecting said first radiating conductor and said parasitic element;

a feeding conductor with a feeding point, which electronically connects with said first radiating conductor; and a second radiating conductor arranged on said third surface of said housing and spaced from said ground portion and said first radiating conductor, which electronically connects with said feeding conductor.

14. The multi-band antenna as claimed in claim 13, wherein said second radiating conductor has a first radiating segment spaced from said ground portion and connected with said feeding conductor, a second radiating segment arranged close to said first radiating conductor, and a third radiating segment connecting said first radiating segment and said second radiating segment.

15. The multi-band antenna as claimed in claim 14, wherein the length of said first radiating segment of said second radiating conductor is shorter than the length of said second radiating segment of said second radiating conductor.

16. The multi-band antenna as claimed in claim 14, wherein the gap between the first radiating segment of the second radiating conductor and the ground portion is larger than the gap between the second segment of the second radiating conductor and the first radiating conductor.

17. The multi-band antenna as claimed in claim 13, wherein said housing has a fourth surface connecting said first, second and third surfaces of said housing, said feeding conductor is arranged on said fourth surface of said housing, which electronically connects said first end of said first radiating conductor and one end of said second radiating conductor.

18. The multi-band antenna as claimed in claim 17, wherein said first, second and third surfaces of said housing are formed as an elongated shape, the area of said first surface of said housing being similar to the area of said second surface of said housing, the area of said third surface of said housing being larger than the area of said first surface of said housing, the area of said fourth surface of said housing being smaller than the area of said first surface of said housing.

19. The multi-band antenna as claimed in claim 13, wherein said feeding point is arranged where said feeding conductor connects with said second radiating conductor.

20. The multi-band antenna as claimed in claim 13, wherein said first radiating conductor, said second radiating, said parasitic element are formed as an elongated shape.

21. The multi-band antenna as claimed in claim 13, wherein said feeding conductor is formed as an elongated shape.

22. The multi-band antenna as claimed in claim 13, wherein said trap circuit is arranged between said second end of said first radiating conductor and said third end of said parasitic element.

23. The multi-band antenna as claimed in claim 13, wherein said housing is configured in a portable electrical device, said ground portion of said multi-band antenna electronically connects to ground of said portable electrical device.

24. The multi-band antenna as claimed in claim 13, wherein said portable electrical device is a notebook.

25. The multi-band antenna as claimed in claim 13, wherein said housing is made of insulation material.

26. The multi-band antenna as claimed in claim 13, wherein said first radiating conductor, said second radiating conductor, said feeding conductor and said parasitic element are made of thin foil.

* * * * *